US008733879B2

(12) United States Patent
Numata

(10) Patent No.: US 8,733,879 B2
(45) Date of Patent: May 27, 2014

(54) INKJET RECORDING APPARATUS AND PRINTING METHOD

(75) Inventor: Hironori Numata, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 142 days.

(21) Appl. No.: 13/252,519

(22) Filed: Oct. 4, 2011

(65) Prior Publication Data

US 2012/0098881 A1 Apr. 26, 2012

(30) Foreign Application Priority Data

Oct. 22, 2010 (JP) ..... 2010-237701

(51) Int. Cl.
*B41J 29/38* (2006.01)
*B41J 2/01* (2006.01)

(52) U.S. Cl.
USPC ..... 347/16; 347/101; 347/102

(58) Field of Classification Search
USPC ..... 347/101–102, 16
See application file for complete search history.

(56) References Cited

U.S. PATENT DOCUMENTS

| | | | | |
|---|---|---|---|---|
| 2005/0253912 | A1* | 11/2005 | Smith et al. | 347/102 |
| 2006/0209138 | A1* | 9/2006 | Kachi | 347/68 |
| 2009/0244160 | A1* | 10/2009 | Nakagaki | 347/16 |
| 2009/0295898 | A1* | 12/2009 | Takatsuka | 347/104 |
| 2011/0199447 | A1* | 8/2011 | Takahashi et al. | 347/102 |

FOREIGN PATENT DOCUMENTS

| | | |
|---|---|---|
| JP | 05-338126 | 12/1993 |
| JP | 6-210845 | 8/1994 |
| JP | 2001-334647 | 12/2001 |
| JP | 2002-292837 | 10/2002 |
| JP | 2002-361850 | 12/2002 |
| JP | 2003-305827 | 10/2003 |
| JP | 2004-142166 | 5/2004 |
| JP | 2006-095774 | 4/2006 |
| JP | 2010-83040 | 4/2010 |
| JP | 2011-5673 | 1/2011 |

OTHER PUBLICATIONS

Notice of Rejection issued Mar. 4, 2014, in Japanese Patent Application No. 2010-237701, filed Oct. 22, 2010.

* cited by examiner

*Primary Examiner* — Jason Uhlenhake
(74) *Attorney, Agent, or Firm* — Oblon, Spivak, McClelland, Maier & Neustadt, L.L.P.

(57) ABSTRACT

An inkjet recording apparatus includes a drying chamber on a downstream side of a recording head along a conveyance path for a sheet-shaped recording medium originally wound to be like a roll; and a drying unit circulating gas. The drying unit includes a heat pump separating water droplets from gas containing moisture returned after moisture is moved from the sheet-shaped recording medium, heating the gas, supplying the gas as high temperature dried gas to the drying chamber, causing moisture to move from the sheet-shaped recording medium to the gas in the drying chamber and returning the gas to which the moisture has been moved and which becomes gas containing moisture to the drying unit.

17 Claims, 13 Drawing Sheets

INKJET RECORDING APPARATUS AND PRINTING METHOD

BACKGROUND OF THE INVENTION

1. Field of the Invention

The present invention relates to an inkjet recording apparatus and a printing method. In particular, the present invention relates to an inkjet recording apparatus which may be an image forming apparatus such as a copier, a printer, a facsimile machine, a digital multifunction peripheral having these functions in a combined manner or a printing machine forming (printing) an image according to an inkjet method on a sheet-shaped recording medium such as paper or the like, cloth or the like, film or the like, or a synthetic resin material wound on a roll, and a printing method carried out in the inkjet recording apparatus.

2. Description of the Related Art

In an inkjet recording apparatus, ink droplets are discharged onto a sheet-shaped recording medium by an inkjet head, the ink droplets are caused to penetrate into the sheet-shaped recording medium or are caused to adhere to a surface of the sheet-shaped recording medium so that an image is formed or printed on the sheet-shaped recording medium. Since ink droplets are used, as an atmosphere of a printing area comes to have a high humidity environment, and not only the printing area of the sheet-shaped recording medium at which printing is carried out but also the sheet-shaped recording medium itself may become moist.

On the other hand, in an inkjet recording apparatus carrying out high-speed printing, in many cases, a continuous sheet of paper (sheet of paper), wound to be like a roll, is drawn out from the roll, printing is carried out thereon, and after that, the continuous sheet of paper is again wound to be like a roll. Therefore, it is necessary to dry the continuous sheet of paper before being wound. Otherwise, staining, blurring, ink running, or such may occur due to adhesion of the printed ink, or trouble may occur during winding the continuous sheet of paper.

Therefore, Japanese Laid-Open Patent Application No. 2002-361850 (Patent Document 1) discloses providing a hot air machine that generates hot air; a drying body in which a continuous sheet of paper is dried; and a dehumidification machine that dehumidifies the hot air. Then, the hot air generated by the hot air machine is led to the drying body, the continuous sheet of paper is thus dried, the hot air led to the drying body is led to the dehumidification machine and is dehumidified, and the dehumidified hot air is again led to the drying body.

Japanese Laid-Open Patent Application No. 2010-83040 (Patent Document 2) discloses providing a drying part including a main drying section for drying cloth on which recording has been carried out by an inkjet recording part; auxiliary drying sections disposed to sandwich the main drying section; and a conveyance part for conveying the cloth. The auxiliary drying sections are set to have an atmosphere of a normal temperature and low humidity by using a dehumidification machine. In the main drying section, the air in the inside is circulated by an air flow generator and is fed to a surface of the cloth, and thus, the cloth is dried.

According to the related art of Patent Document 1, the continuous sheet of paper is dried by the hot air. According to the related art of Patent Document 2, the cloth is dried in the normal temperature. In each case, the air used in the drying process is dehumidified, and is again used for the drying process.

According to the related art of Patent Document 1, the hot air is fed to a housing, the continuous sheet of paper is caused to pass through the housing, and the continuous sheet of paper is dried. However, improving the drying efficiency by reducing the power consumption or such is not particularly considered there. Further, it may be difficult to apply this method to a high-speed inkjet recording apparatus. According to the related art of Patent Document 2, a space in the inside of the drying part is maintained to have a normal temperature (25 through 50° C.) and low humidity (0 through 20%), and the cloth is caused to pass through the space during a time period on the order of 1 through 5 minutes for drying the cloth. However, since the cloth is to be caused to pass through the space during the time period on the order of 1 through 5 minutes, it may be difficult to apply this method to a high-speed inkjet recording apparatus.

Thus, according to the related art of Patent Documents 1 and 2, if an inkjet head is used to carry out printing at a high speed, the speed of drying the printed sheet may not catch up with the printing speed, and thus, the upper limit of the printing speed may depend on the time period required for the drying process. Further, when the temperature is increased in order to improve the drying efficiency, the power consumption may be increased accordingly. Further, an areal deviation may occur in drying the sheet of paper, and thereby, the printing quality may be degraded.

SUMMARY OF THE INVENTION

According to an embodiment of the present invention, an inkjet recording apparatus capable of discharging ink from a recording head and forming a printed image on a sheet-shaped recording medium, includes a drying chamber provided on a downstream side of the recording head along a conveyance path of the sheet-shaped recording medium originally wound to be like a roll; and a drying unit configured to circulate gas by using plural ducts connected to the drying chamber. The drying unit includes a heat pump configured to separate water droplets from gas containing moisture that has been returned after moisture has been moved from the sheet-shaped recording medium to the gas, heat the gas to have a high temperature to be high temperature dried gas, supply the high temperature dried gas to the drying chamber from the duct of the drying chamber on a gas supply side, cause moisture to move from the sheet-shaped recording medium to the high temperature dried gas in the drying chamber, and return the gas to which the moisture has been moved and which becomes gas containing moisture to the inside of the drying unit from the duct of the drying chamber on a gas discharge side.

According to another aspect of the embodiment of the present invention, a printing method is a method in an inkjet recording apparatus of discharging ink from a recording head and forming a printed image on a sheet-shaped recording medium. The inkjet recording apparatus includes a drying chamber provided on a downstream side of the recording head along a conveyance path of the sheet-shaped recording medium originally wound to be like a roll; and a drying unit configured to circulate gas by using plural ducts connected to the drying chamber. The drying unit includes a heat pump configured to separate water droplets from gas containing moisture having been returned after moisture has been moved from the sheet-shaped recording medium to the gas, heat the gas to have a high temperature to be a high temperature dried gas, supply the high temperature dried gas to the drying chamber from the duct of the drying chamber on a gas supply side, cause moisture to move from the sheet-shaped recording medium to the high temperature dried gas in the drying chamber, and return the gas to which the moisture has been moved and which becomes gas containing moisture to the inside of the drying unit from the duct of the drying chamber on a gas discharge side. The printing method includes, when starting printing operations, reading reference data for printing stored in a data storage part and obtaining control conditions of a pressure reduction unit and a compression unit; starting idling operations of the pressure reduction unit and the compression unit of the heat pump according to the obtained control conditions; when receiving printing data from a host apparatus, extracting print density data from the printing data; reading reference data from the data storage part corresponding to the extracted print density data and obtaining control conditions of the pressure reduction unit and the compression unit; starting printing under the obtained control conditions; detecting a humidity in the drying chamber; reading reference data from the data storage part corresponding to the detected humidity and the extracted print density data, and obtaining control conditions of the pressure reduction unit and the compression unit; and carrying out printing under the obtained control conditions.

Other objects, features and advantages of the embodiment of the present invention will become more apparent from the following detailed description when read in conjunction with the accompanying drawings.

DETAILED DESCRIPTION OF THE EMBODIMENTS

Figure 1:
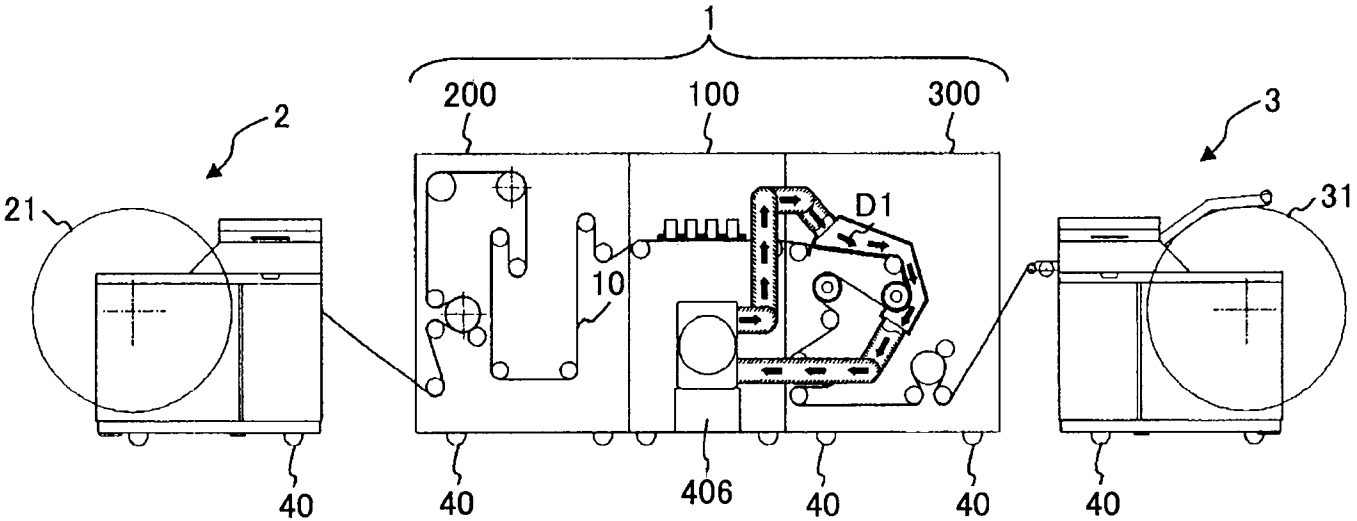
FIG. 1 shows a system of the entirety of an inkjet recording apparatus according to an embodiment of the present invention viewed from a front side.

In each of embodiments of the present invention described below, a recording head corresponds to inkjet heads 110; a sheet-shaped recording medium corresponds to a sheet of paper 10; an inkjet recording apparatus corresponds to an inkjet apparatus 1; a heat pump corresponds to a heat pump 406; a sheet-shaped recording medium originally wound to be like a roll corresponds to a sheet of paper 10; a conveyance path corresponds to a conveyance path 111; a drying chamber corresponds to a chamber 412; ducts correspond to first and second ducts 411, 413; a drying unit corresponds to a paper drying unit 400; water droplets correspond to water droplets 409; high temperate dried gas corresponds to high temperate dried air; a duct on a gas supply side corresponds to the first duct 411; a duct on a gas discharge side corresponds to the second duct 413; a shutter member corresponds to a shutter 414; a driving unit corresponds to a driving mechanism 480 (FIG. 9); a compression unit corresponds to a compression unit 450; a pressure reduction unit corresponds to a pressure reduction unit 460; a blower corresponds to a blower 420; a control part corresponds to a control part 120; a detection part corresponds to a humidity sensor 405; and a data storage part corresponds to a data storage part 123.

According to each of the embodiments of the present invention, since a heat pump dries a sheet of paper, it is possible to positively dry the sheet of paper without deforming the sheet of paper, and as a result, it is possible to increase a printing speed of an inkjet recording apparatus and reduce power consumption of the inkjet recording apparatus without degrading printing quality.

Thus, according to the embodiments of the present invention, the heat pump is used in a drying process. Further, a flow rate of dried air, a cross-sectional area of a chamber through which a sheet of paper (or a sheet member) is caused to pass during the drying process, and so forth, are controlled. Thereby, it is possible to achieve high speed and efficient drying. Below, the embodiments of the present invention will be described with reference to drawings.

FIG. 1 shows a system configuration of the entirety of an inkjet recording apparatus (which may be simply referred to as an inkjet apparatus) 1 according to the embodiment of the present invention. In FIG. 1, the system according to the embodiment basically includes the inkjet apparatus 1, a paper supply apparatus (un-winder) 2 and a winding apparatus (re-winder) 3. The paper supply apparatus 2, the inkjet apparatus 1 and the winding apparatus 3 are arranged along a direction along which a sheet of paper is conveyed in the stated order along a straight line. It is noted that according to the embodiment, these apparatuses 1, 2 and 3 are arranged on a floor surface of the same level via wheels 40 provided to the bottoms of the apparatuses 1, 2 and 3.

The paper supply apparatus 2 supplies a sheet of paper 10 from a rolled sheet of paper 21 in which a sheet of paper is continuously wound on a roll, to the inkjet apparatus 1, while the sheet of paper is being drawn out from the rolled sheet of paper 21 toward the inkjet apparatus 1. The winding apparatus 3 winds the sheet of paper 10 on a roll, on which sheet of paper 10 printing has been carried out by the inkjet apparatus 1. As a result of the entire sheet of paper 10 being thus wound on the roll, a rolled sheet of paper 31 is obtained. The obtained rolled sheet of paper 31 is then removed from the winding apparatus 3, and is transferred to a subsequent process. It is noted that here, the sheet of paper 10 means a continuous sheet of paper, which is originally wound on the roll in the paper supply apparatus 2 as the rolled sheet of paper 21. Thus, the sheet of paper 10 means continuous-form paper. Further, according to the embodiment, the sheet of paper 10 is shown merely as a typical example of a sheet-shaped recording medium. Therefore, the sheet of paper 10 may be expanded to a sheet-shaped member made of paper or the like, cloth or the like, film or the like, synthetic resin, or such.

The inkjet apparatus 1 includes an inkjet image forming part 100 including inkjet heads 110 (see FIG. 2); an in-feed unit 200 that is disposed on a paper-conveyance-direction upstream side (front stage) and feeds the sheet of paper 10 supplied by the paper supply apparatus 2 to the inkjet image forming part 100; and an out-feed unit 300 that feeds the sheet of paper 10 on which printing has been carried out by the inkjet image forming part 100 to the winding apparatus 3.

Figure 2:
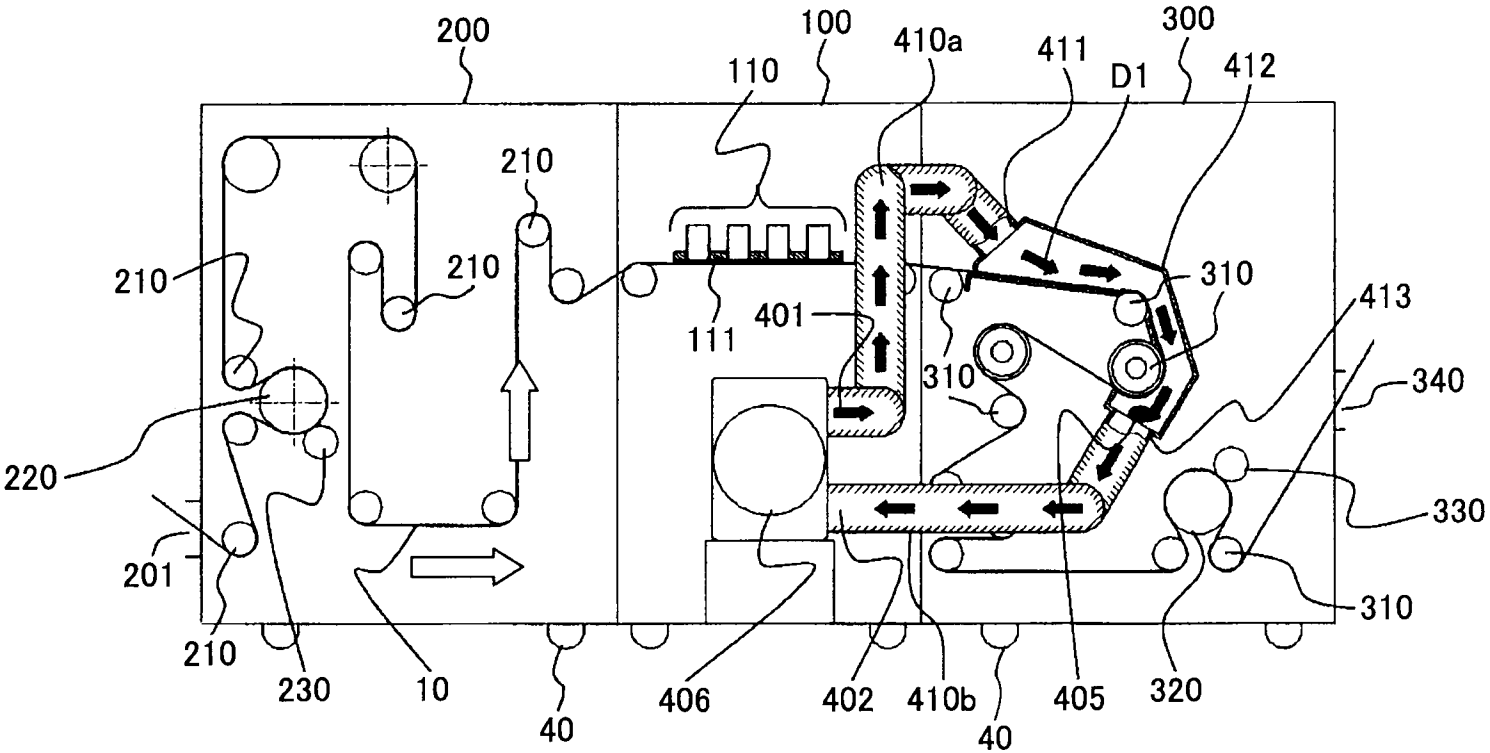
FIG. 2 shows a general configuration of the inkjet recording apparatus shown in FIG. 1 viewed from a front side in a magnifying manner.

FIG. 2 shows a general configuration of the inkjet apparatus 1 shown in FIG. 1 in a magnifying manner. In FIG. 2, the in-feed unit 200 includes plural guide rollers 210, an in-feed roller 220, a nip roller 230 and so forth, and draws in the continuous-form paper 10 from the paper supply apparatus 2 via a paper supply hole 201 formed on a side surface of the in-feed unit 200. In the in-feed unit 200, the sheet of paper 10 is led from the guide roller 210 to a nip between the in-feed roller 220 and the nip roller 230, and is fed to the inkjet image forming part 100 in a state where a certain tension is given to the sheet of paper 10 by the plural guide rollers 210.

The inkjet image forming part 100 includes the inkjet heads 110 and a control part 120 (see FIG. 9) described later. The inkjet image forming part 100 carries out control of forming an image on the sheet of paper 10 and feeding the sheet of paper 10, based on instructions given by a host apparatus 130 (see FIG. 9). The inkjet heads 110 are disposed at positions facing a paper conveyance path 111, discharge ink droplets to the sheet of paper 10 being conveyed at high speed, and form a printed image on the sheet of paper 10. In front of the inkjet image forming part 100, a paper drying unit 400 (see FIG. 3) including a heat pump 406 is disposed. Blowing paths 410*a* and 410*b* are provided, and by using the blowing paths 410*a* and 410*b*, air fed from a discharge hole 401 of the heat pump 406 passes through the out-feed unit 300 and is returned to the heat pump 406 via a suction hole 402. The blowing path 410*a* on an upstream side is connected with a drying chamber (which will be simply referred to as a "chamber", hereinafter) 412 via a first duct 411 on an upstream side. The blowing path 410*b* on a downstream side is connected with the chamber 412 via a second duct 413 on a downstream side. In the chamber 412, a conveyance path for conveying the sheet of paper 10 is formed.

The chamber 412 is disposed on a downstream side of the conveyance path 111 facing the inkjet heads 110. In the chamber 412, high temperature dried air blown from the heat pump 406 is supplied to a space on a surface of the sheet of paper 10 having been printed. Thereby, the high temperature dried air comes into contact with the surface of the sheet of paper 10, and thus, the sheet of paper 10 can be dried and dehumidified. Further, a humidity sensor 405 is disposed in the inside of the second duct 413 or at a position in the inside of the chamber 412 near the inlet to the second duct 413, and is used to detect the humidity of an atmosphere in the inside of the chamber 412.

In the out-feed unit 300, plural guide rollers 310 including a guide roller 310 for causing the sheet of paper 10 to pass through the inside of the chamber 412 are provided. Conveyance force is given to the sheet of paper 10 by an out-feed roller 320 and a nip roller 330 provided on the most downstream side in the paper conveyance direction. The sheet of paper 10 is fed to the winding apparatus 3 from a paper ejection hole 340 via the last stage guide roller 310, and then is wound by the winding apparatus 3 to be like a roll. According to the embodiment, a printing process is carried out on the continuous-form paper 10 extending from the leading end of the rolled sheet of paper 21 in the paper supply apparatus 2 to the trailing end of the rolled sheet of paper 31 in which the sheet of paper 10 originally drawn out from the rolled sheet of paper 21 has been wound in the winding apparatus 3.

Figure 3:
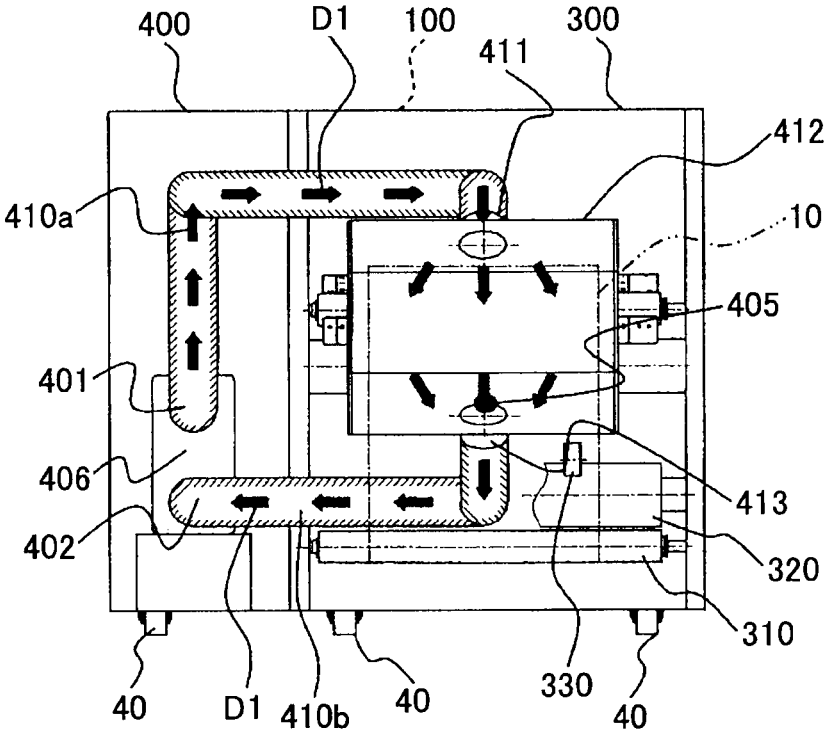
FIG. 3 shows a side view of the inkjet recording apparatus shown in FIG. 2 viewed from a right side.

FIG. 3 shows a right side view of the inkjet apparatus 1 of FIG. 2, where the out-feed roller 320 is partially shown, and the arrangement of the chamber 412, the blowing paths 410*a* and 410*b* and so forth is shown.

As shown in FIG. 3, the paper drying unit 400 including the heat pump 406 is disposed in front of the inkjet image forming part 100. In the paper drying unit 400, high temperature dried air blown from the discharge hole 401 of the heat pump 406 is led by the blowing path 410*a* on the upstream side. Then, the high temperature dried air is supplied to the chamber 412 in the out-feed unit 300, and is returned to the heat pump 406 from the chamber 412 via the blowing path 410*b* on the downstream side. Thus, the blowing paths 410*a* and 410*b* are joined to the chamber 412 by the first duct 411 and the second duct 413 at approximately center areas of peripheral surfaces of the chamber 412 along a direction perpendicular to the paper conveyance direction on the most upstream side and the most downstream side of the chamber 412 along the paper conveyance direction, respectively. Thereby, a circulation path by which the warm air exiting from the heat pump 406 is returned to the heat pump 406 is created.

As described above, the conveyance path for the sheet of paper 10 is formed in the chamber 412, as shown in FIG. 2, along an inner wall surface on the bottom side of the chamber 412. The sheet of paper 10 is led to the outside of the chamber 412 from the guide roller 310 of the last stage in the chamber 412. The high temperature dried air having removed moisture from the sheet of paper 10 is led to the blowing path 410*b* on the downstream side from the downstream side the guide roller 310 of the last stage, and is returned to the inside of the heat pump 406. It is noted that although the first and second ducts 411 and 413 are single pieces on the discharge side and the suction side, respectively, plural of the first duct 411 and plural of the second duct 413 may be provided on the respective sides in parallel or arranged at positions such that a flow rate distribution in the chamber 412 becomes uniform. Thereby, the circulation efficiency of warm air is improved. Further, the example shown in FIGS. 1, 2 and 3 is an example where the warm air is fed in the direction indicated by arrows D1 (forward direction) the same as the direction in which the paper of sheet 10 is conveyed.

Figure 4:
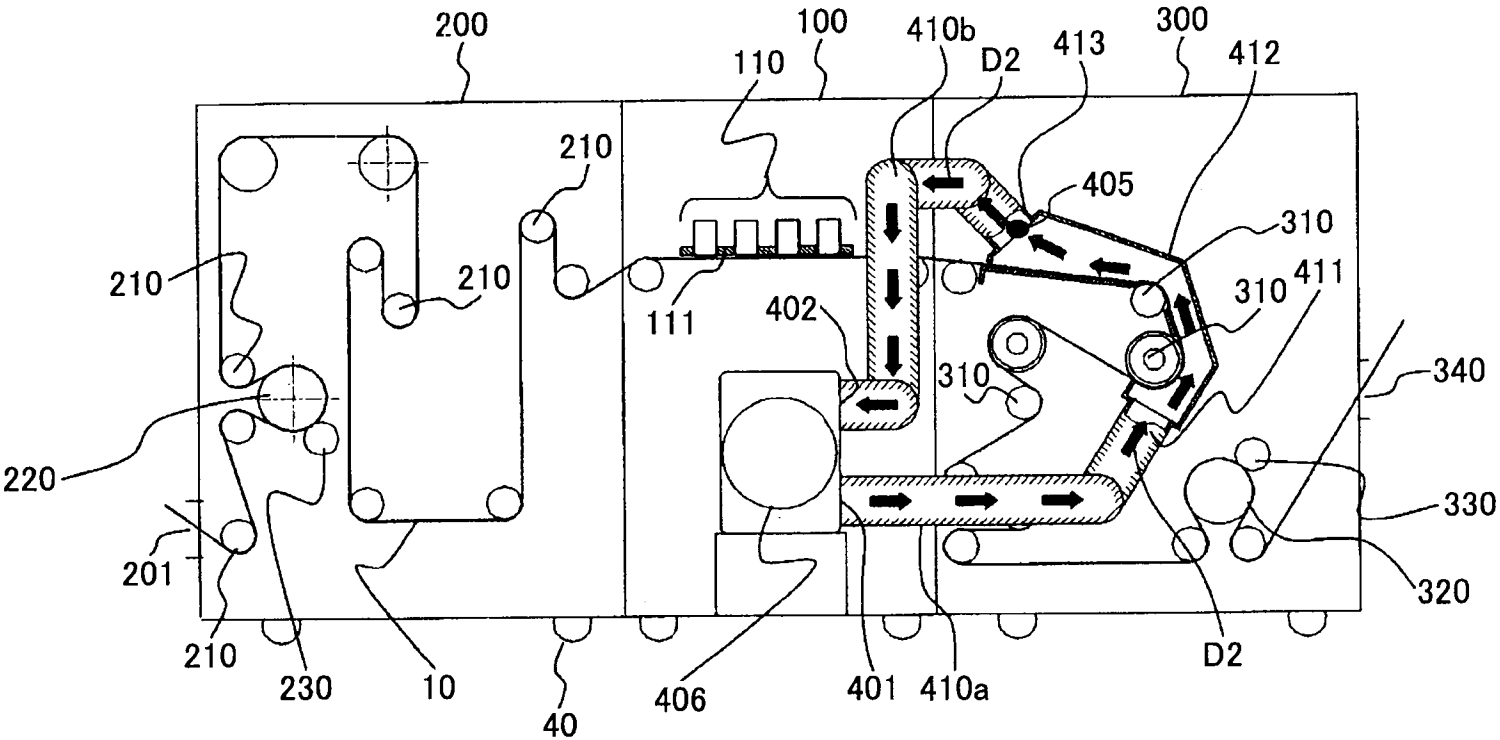
FIG. 4 shows a general configuration of an inkjet recording apparatus according to another embodiment of the present invention viewed from a front side where blowing is carried out in a direction reverse to a direction in which blowing is carried out in the embodiment shown in FIG. 2.
Figure 5:
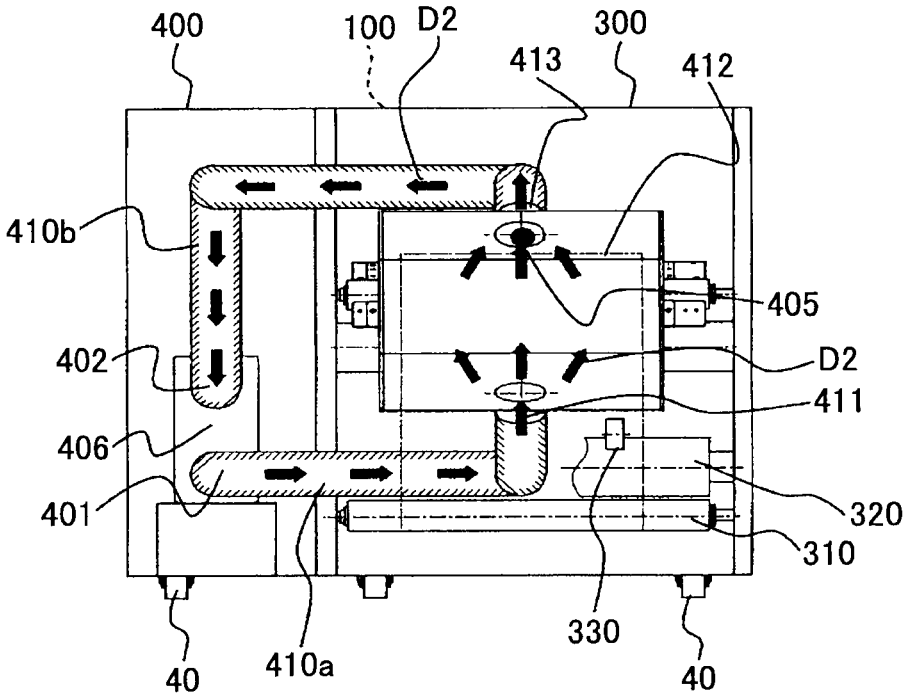
FIG. 5 shows a side view of the inkjet recording apparatus shown in FIG. 4 viewed from a right side.

There may be a case where the warm air from the heat pump 406 is fed in the reverse direction. FIGS. 4 and 5 show the other embodiment of the present invention where the warm air from the heat pump 406 is fed in the reverse direction. FIG. 4 shows a front view of a general configuration of the inkjet apparatus 1 in the other embodiment. FIG. 5 shows a right side view of the general configuration of the inkjet apparatus 1 in the other embodiment. FIG. 4 corresponds to FIG. 2, and FIG. 5 corresponds to FIG. 3. In the example of FIGS. 4 and 5, the direction of blowing from the heat pump 406 indicated by arrows D2 is opposite (reverse) to the direction of conveying the sheet of paper 10. The other parts are the same as those in the embodiment described above with reference to FIGS. 2 and 3, thus the same reference numerals are given to the same parts, and duplicate description will be omitted.

Figure 6:
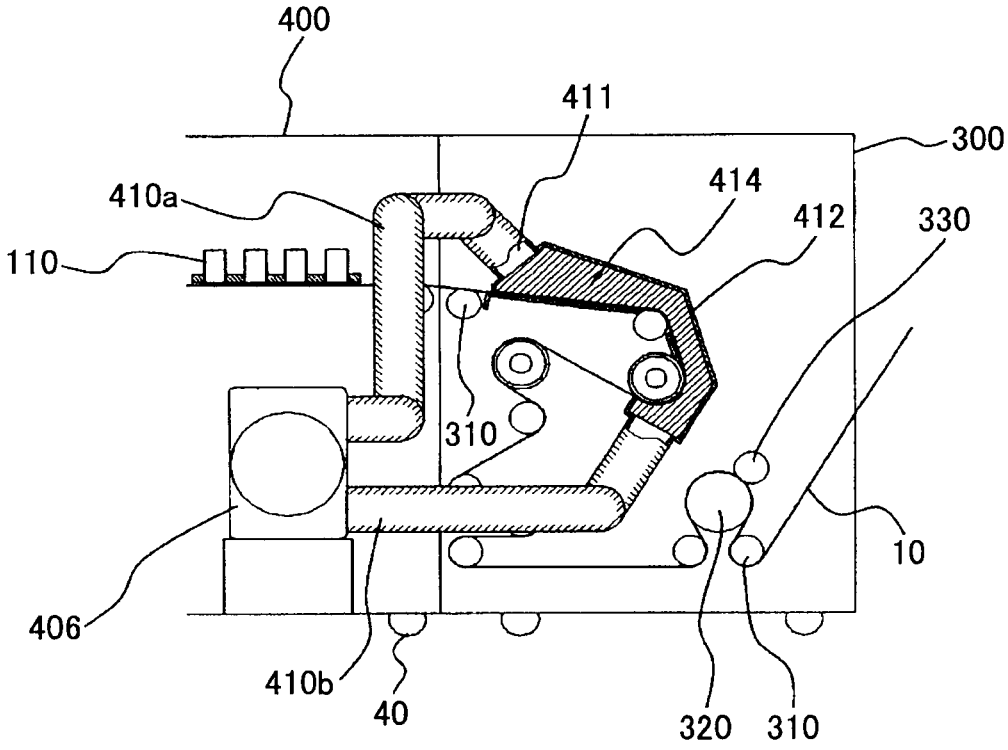
FIG. 6 shows a front view of a configuration of a paper drying unit that changes a flow cross sectional area of a chamber, applicable to the embodiment of FIGS. 2-3 and the other embodiment of FIGS. 4-5.
Figure 7:
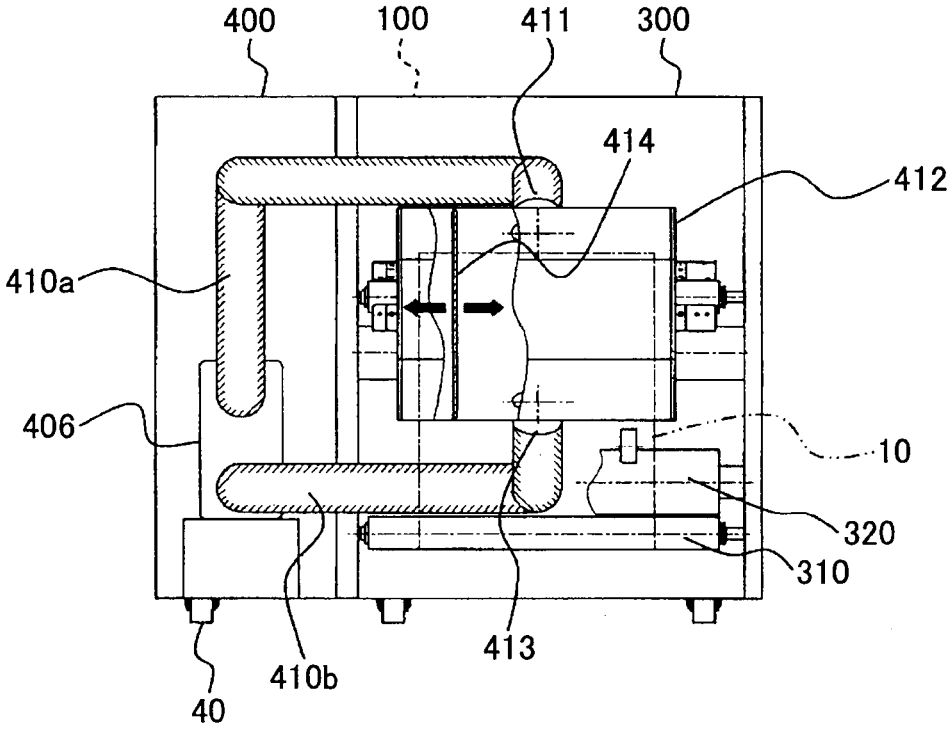
FIG. 7 shows a right side view of the configuration of the paper drying unit that changes the flow cross sectional area of the chamber shown in FIG. 6.

FIGS. 6 and 7 show a configuration of changing a flow cross sectional area of the chamber. FIG. 6 shows a front view and FIG. 7 shows a right side view. As shown in FIG. 7, in the configuration, a shutter 414 is provided in parallel to the paper conveyance direction in the chamber 412, and the position of the shutter 414 is changed by a driving mechanism 480 (see FIG. 9) in directions perpendicular to the paper conveyance direction. A shape of the shutter 414 may be, as shown in FIG. 6, approximately the same as a sectional shape of the inside of the chamber parallel to the paper conveyance direction. The position of the shutter 414 is changed in directions perpendicular to the paper conveyance direction as shown in FIG. 7 to correspond to the actual size in the width direction of the sheet of paper 10. Thus, the flow cross sectional width of the chamber 412 is controlled, and the flow cross sectional width becomes such that the efficiencies of the heat pump 406 and drying the sheet of paper 10 are maximized depending on the actual width of the sheet of paper 10. The driving mechanism 480 may use a motor, for example, and drive and position the shutter 414 so that it is possible to easily position the shutter 414 with high accuracy. It is noted that the position of the shutter 414 may be determined based on the actual width of the sheet of paper 10. Alternatively, a relationship between the actual width of the sheet of paper 10, the position of the shutter 414 and the efficiencies may be previously obtained in a laboratory or such, and the position of the shutter 414 at which the best efficiencies are obtained may be selected and determined to be used. Control of driving in the driving mechanism 480 is carried out by the control part 120 via a motor driver 126 (see FIG. 9).

Figure 8:
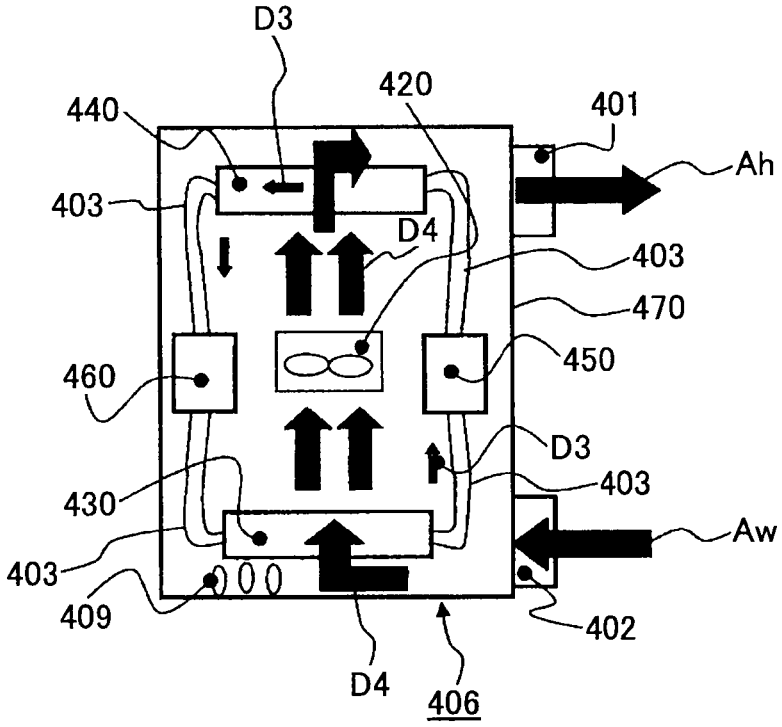
FIG. 8 shows a general configuration of functions of a heat pump, applicable to the embodiment of FIGS. 2-3 and the other embodiment of FIGS. 4-5.

FIG. 8 shows a general configuration of functions of the heat pump 406. The heat pump 406 is a heat pump using a heating medium, and includes a blower 420, respective heat exchangers 430 and 440 on a cooling side and a heating side, a compression unit 450 and a pressure reduction unit 460. These parts/components are held in a case 470 having the discharge hole 401 and the suction hole 402. The heat exchanger 430 on the cooling side, the pressure reduction unit 460, the heat exchanger 440 on the heating side and the compression unit 450 are connected by medium pipe lines 403, and thus, a closed circulation pipe line is formed. The heating medium is circulated in a direction of arrows D3, and the high temperature dried air to be supplied to the chamber 412 is circulated in a direction of arrows D4.

The blower 420 is a driving source of the warm air to be supplied to the chamber 412, and is disposed between the heat exchanger 430 on the cooling side and the heat exchanger 440 on the heating side. The blower 420 feeds the air containing moisture Aw of the returned side suctioned from the suction hole 402 from the heat exchanger 430 on the cooling side to the heat exchanger 440 on the heating side. The blower 420 then feeds out the high temperature dried air Ah heated to a certain temperature in the heat exchanger 440 on the heating side via the discharge hole 401. The pressure of the heating medium in the heat pump 406 is reduced by the pressure reduction unit 460, thus the temperature of the heating medium becomes lower than the temperature of the ambient temperature, and the heating medium is sent to the heat exchanger 430 on the cooling side. Thereby the heat exchanger 430 on the cooling side is cooled, and separates the air containing moisture (warm air) Aw suctioned from the suction hole 402 into water droplets 409 and dried air.

On the other hand, the heating medium passing through the heat exchanger 430 on the cooling side is fed to the compression unit 450, is then compressed by the compression unit 450, and thus has a high temperature. The heating medium thus having the high temperature is fed to the heat exchanger 440 on the heating side, and in the heat exchanger 440 on the heating side, heat transfer is carried out from the heating medium to the dried air provided by the heat exchanger 430 on the cooling side after being dehumidified there. After that, the heating medium is fed to the pressure reduction unit 460. On the other hand, the air thus having passed through the heat exchanger 440 on the heating side becomes the high temperature dried air Ah and is fed to the blowing path 410*a* from the discharge hole 401.

Thus, the heat pump 406 carries out heat transfer between the heating medium and the air circulating the blowing paths 410*a* and 410*b* in a process where expansion and compression of the heating medium are repeated and bi-directional heat transfer is carried out. Thereby, the heat pump 406 removes moisture from the air containing moisture Aw having removed moisture from the sheet of paper 10 and having been led to the heat pump 406 from the suction hole 402, supplies a heat amount sufficient to dry the sheet of paper 10 to the warm air, and feeds the warm air as the high temperature dried air Ah at 50° C. through 100° C. to the chamber 412.

Since such a heat pump and a heat exchange principle are well known, a detailed description will be omitted. Further, performances of heat exchangers concerning heat transfer functions and performances of blowing air are determined appropriately depending on apparatuses in which the heat exchangers are used, and thus, also details thereof will be omitted.

Thus, the high temperature dried air Ah is supplied to the inside of the chamber 412 by the blower 420 of the heat pump 406 via the blowing path 410*a* on the upstream side and the first duct 411 from the discharge hole 401. Then, after the high temperature dried air Ah dries the sheet of paper 10 in the chamber 412 and becomes the air containing moisture Aw, the air containing moisture Aw is collected in the heat pump 406 from the suction hole 402 via the second duct 413 and the blowing path 410*b* on the downstream side. The heat pump 406 changes the collected air containing moisture Aw into the high temperature dried air Ah again and feeds the high temperature dried air Ah. Thus, the circulation path is formed, and thereby, it is possible to dry the sheet of paper 10 in the inkjet apparatus 1 that carries out printing at high speed. It is noted that the printing at high speed is assumed as, for example, printing at a speed of conveying the sheet of paper 10 at, for example, 75 m/min through 150 m/min. It is noted that the air is one example of gas.

At this time, also as shown in FIGS. 2 and 4, the sheet of paper 10 is conveyed along the bottom surface in the inside of the chamber 412, the high temperature dried air Ah moves on the printing side of the sheet of paper 10 at a certain relative speed, and transfers moisture contained in the sheet of paper 10 to the high temperature dried air Ah. In this case, it is preferable that the speed of blowing from the blower 420 is determined so that the above-mentioned certain relative speed is such that the transfer of moisture from the sheet of paper 10 to the high temperature dried air Ah is maintained in an equilibrium state.

Figure 9:
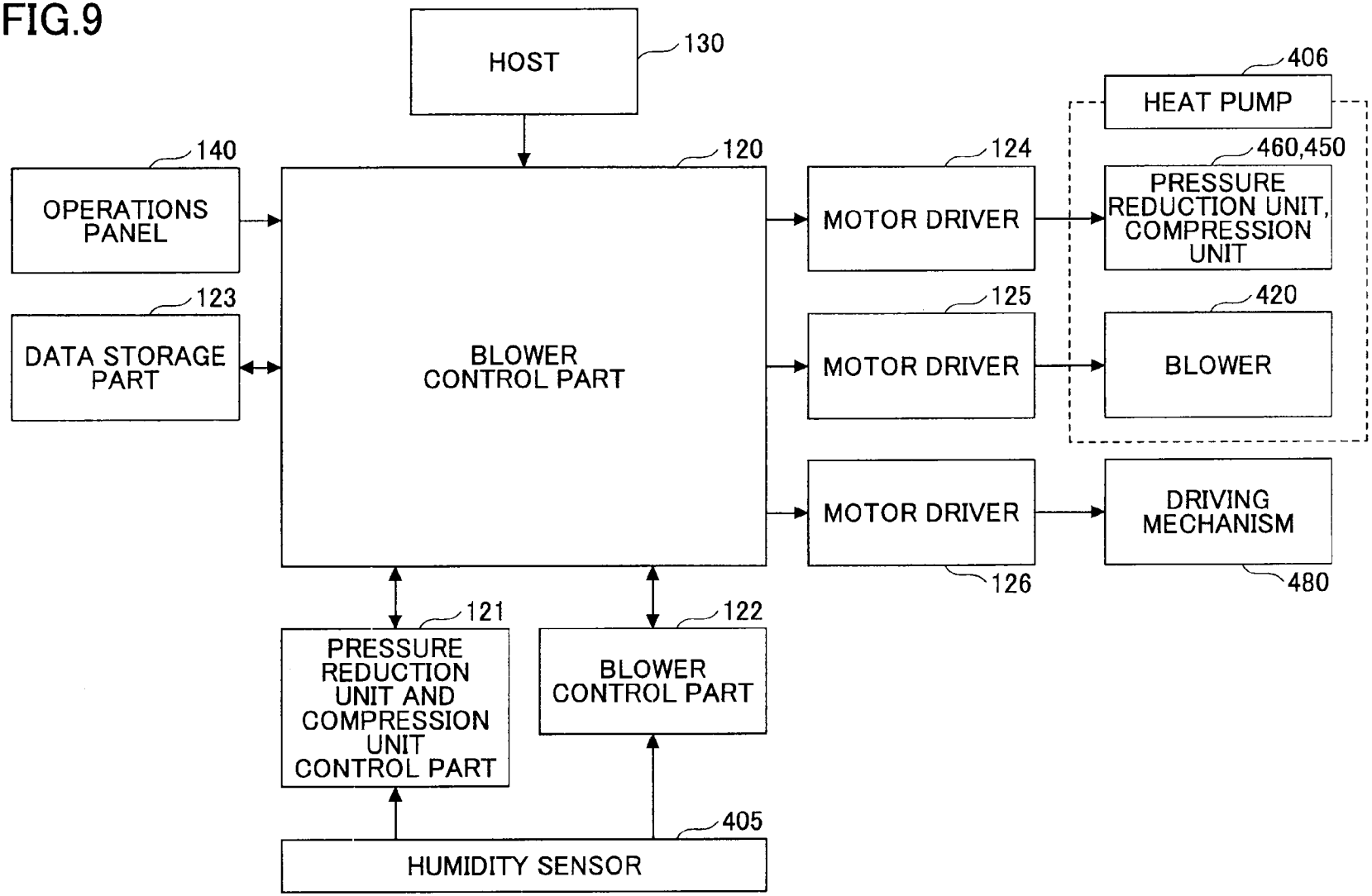
FIG. 9 shows a block diagram of a control configuration of the inkjet recording apparatus including the heat pump, applicable to the embodiment of FIGS. 2-3 and the other embodiment of FIGS. 4-5.

FIG. 9 is a block diagram showing a control configuration of the inkjet apparatus 1 including the heat pump 406. As shown in FIG. 9, the inkjet apparatus 1 includes the control part 120 connected to the host apparatus 130 so that communication can be carried out therebetween. A pressure reduction unit and compression unit control part 121, a blower control unit 122, an operations panel 140, a data storage part 123 and motor drivers 124, 125 and 126 are connected to the control part 120. The motor driver 124 controls driving of the pressure reduction unit 460 and the compression unit 450. The motor driver 125 controls driving of the blower 420. The motor driver 126 controls driving of the driving mechanism 480. Further, the detection output of the humidity sensor 405 detecting the humidity in the inside of the chamber 412 is input to the pressure reduction unit and compression unit control part 121 and the blower control unit 122. Thus, the respective control parts 121 and 122 obtain the humidity information based on the amount of moisture evaporating from the sheet of paper 10 and transferred to the warm air, and output control information to the control part 120 of the inkjet apparatus 1. The control part 120 of the inkjet apparatus 1 reads control data for controlling drying the sheet of paper 10 stored in the data storage part 123, and controls the pressure reduction unit 460, the compression unit 450 and the blower 420 via the motor drivers 124 and 125 based on the control information from the respective control parts 121 and 122. The operations panel 140 provides a user interface, and includes keys for initial settings by the user, keys for setting various modes, keys for directing operations, and so forth.

It is noted that the control part 120, the pressure reduction unit and compression unit control part 121 and the blower control part 122 include their CPUs, ROMs and RAMs (not shown), respectively. Then, in each of the control parts 120, 121 and 122, the CPU reads program code stored in the ROM, expands the read program in the RAM, and carries out control operations defined by the program code, using the RAM as a work area and a data buffer.

Figure 10:
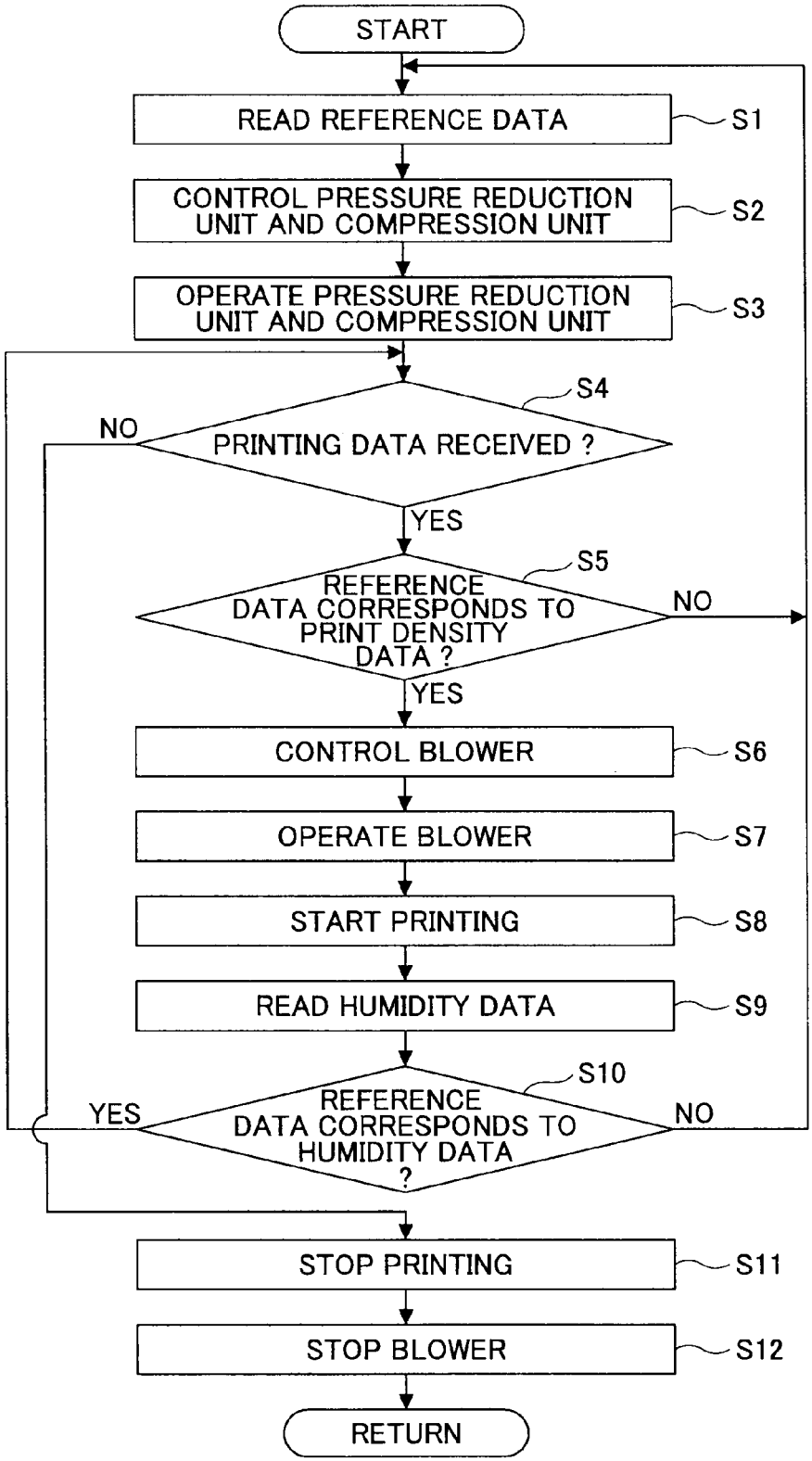
FIG. 10 shows a flowchart of one example of a control procedure of paper drying control operations carried out by a control part, applicable to the embodiment of FIGS. 2-3 and the other embodiment of FIGS. 4-5.

FIG. 10 is a flowchart showing one example of a control procedure of controlling drying of the sheet of paper 10 carried out by the control part 120. In this control procedure, the CPU of the control part 120 reads reference values included in reference data (for printing on the sheet of paper 10) stored in the data storage part 123 (step S1), and under the control of the respective control parts 120 and 121, idling operations of the pressure reduction unit 460 and the compression unit 450 are carried out according to the reference values read in step S1 (steps S2 and S3).

It is noted that the reference data stored in the data storage part 123 includes a data table (for normal humidity) for a case of a certain normal humidity value including respective reference values of the rotational speed (driving speed) of the pressure reduction unit 460, respective reference values of the rotational speed of the compression unit 450 and respective reference values of the rotational speed of the blower 420 corresponding to various print densities. The reference data further includes other data tables (for other humidity levels) for cases of other respective certain humidity values different from the certain normal humidity, the other data tables including respective reference values of the rotational speeds of the pressure reduction unit 460, reference values of the rotational speed of the compression unit 450 and reference values of the rotational speed of the blower 420 corresponding to the various print densities. In step S1, at a first time, the reference values prepared for the idling operations are read from the data table. On the other hand, in step S1 at a subsequent time before the humidity sensor 405 has been read in step S9, the data table (for normal humidity) is selected, and the reference values corresponding to the print density extracted in step S5 of the selected data table (for normal humidity) are read from the data table. Further, in step S1 at a subsequent time after the humidity sensor 405 has been read in step S9, the data table (for other humidity) corresponding to the detection value of the humidity sensor 405 read in step S9 is selected, and the reference values corresponding to the print density extracted in step S5 of the selected data table (for other humidity) are read from the data table.

Next, it is determined whether printing data has been received from the host apparatus 130 (step S4). When printing data has been received (step S4 YES), the CPU of the control part 120 extracts print density data from the printing data, and determines whether the reference values read in step S1 are those corresponding to the extracted print density (step S5).

In a case of not corresponding (step S5 NO), the CPU of the control part 120 returns to step S1, and reads the reference values corresponding to the extracted print density as mentioned above, and the subsequent steps S2, S3, S4 and S5 are repeated. At this time, in steps S2 and S3, the pressure reduction unit 460 and the compression unit 450 are controlled according to the newly read reference values. However, in step S4, the printing data received in the preceding time of step S4 is used as it is. In step S5, since the reference values corresponding to the extracted print density have been read as mentioned above, the determination result in step S5 is YES accordingly. Then, when the determination result in step S5 is YES, the blower 420 is operated under the control of the control part 120 and the blower control part 122 where the rotational speed (driving speed) of the blower 420 is controlled to correspond to the extracted print density of the data table selected in step S1 (step S6 and S7). Next, the inkjet heads 110 are driven and printing is started according to the printing data received in step S4 (step S8).

In the process of the printing, the detection value of the humidity sensor 405 in the inside of the chamber 412 is read (step S9). Then, it is determined whether the data table selected in step S1 corresponds to the detected humidity value (step S10). In a case of not corresponding (step S10 NO), steps S1, S2, S3, S4, S5, S6, S7, S8, S9 and S10 are repeated. At this time, in step S1, as mentioned above, the data table (for other humidity) corresponding to the humidity value detected in step S9 is selected, and from the selected data table, the reference values corresponding to the print density extracted in step S5 is read. Further, in steps S2 and S3, the pressure reduction unit 460 and the compression unit 450 are controlled according to the newly read reference values. In step S4, new printing data is received from the host apparatus 130. In step S5, the print density data is extracted from the newly received printing data. Then, when the reference values read in step S1 do not correspond to the extracted print density (step S5 NO), steps S1, S2, S3, S4 and S5 are repeated as mentioned above, and at this time, as mentioned above, the determination result in step S5 is YES accordingly. Then, when step S5 results in YES, the blower 420 is controlled to operate according to the reference value corresponding to the print density extracted in step S5 of the data table selected according to the humidity value detected in step S9 at the preceding time (step S6 and S7). In step S8, printing is carried out according to the printing data received in step S4. In step S9, the humidity is detected again, and in step S10, when the data table selected according to the humidity data detected at the preceding time does not correspond to the currently detected humidity value (step S10 NO), step S1 through S10 are repeated again. When the determination result in step S10 is YES, steps S4 through S10 are repeated.

Then, when the printing has not been received (step S4 NO), the printing is stopped (step S11), the operation of the blower 420 is stopped (step S12), and next printing is waited for. It is noted that at this time, the pressure reduction unit 460 and the compression unit 450 may be stopped together with the blower 420. However, depending on the current operating state, the idling operations of the pressure reduction unit 460 and the compression unit 450 may be carried out continuously.

Figure 11:
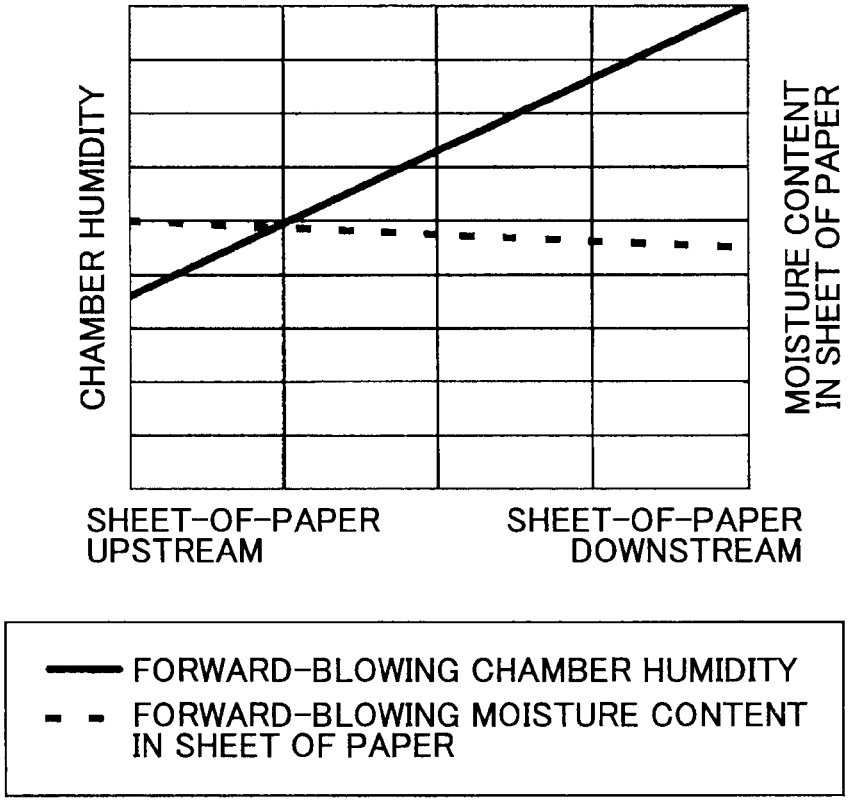
FIG. 11 shows a characteristic graph of drying characteristics in a case where the paper drying control operations are carried out through the control procedure shown in FIG. 10, and shows an example where a direction of conveying a sheet of paper and a direction of blowing are the same as one another, and a blowing speed is low.
Figure 12:
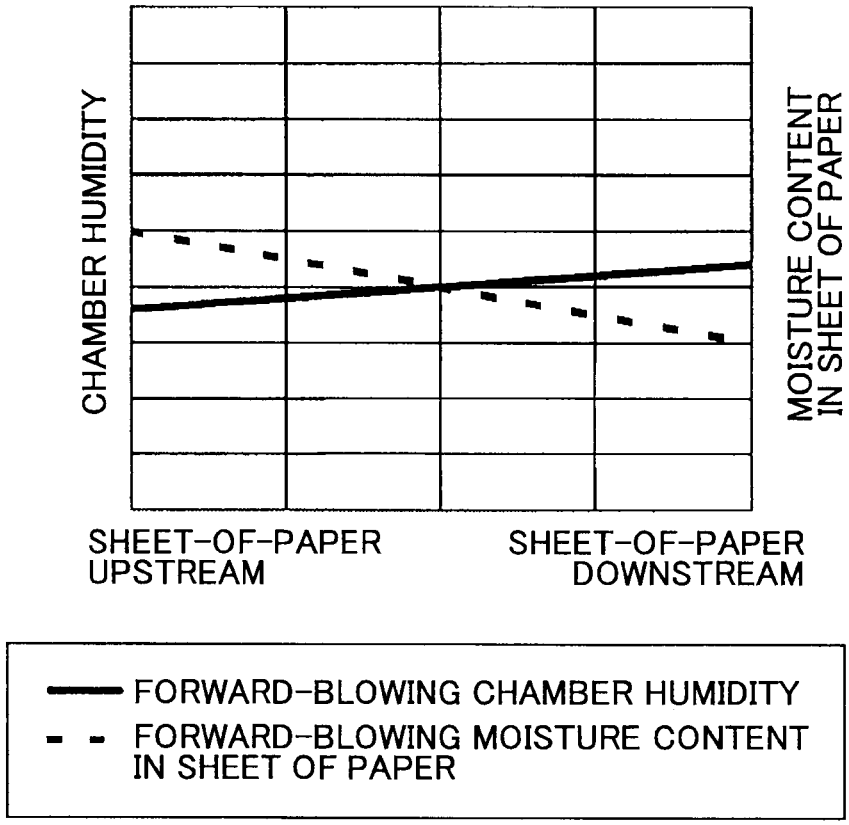
FIG. 12 shows a characteristic graph of drying characteristics in a case where the paper drying control operations are carried out through the control procedure shown in FIG. 10, and shows an example where the direction of conveying a sheet of paper and the direction of blowing are the same as one another, and the blowing speed is high.
Figure 13:
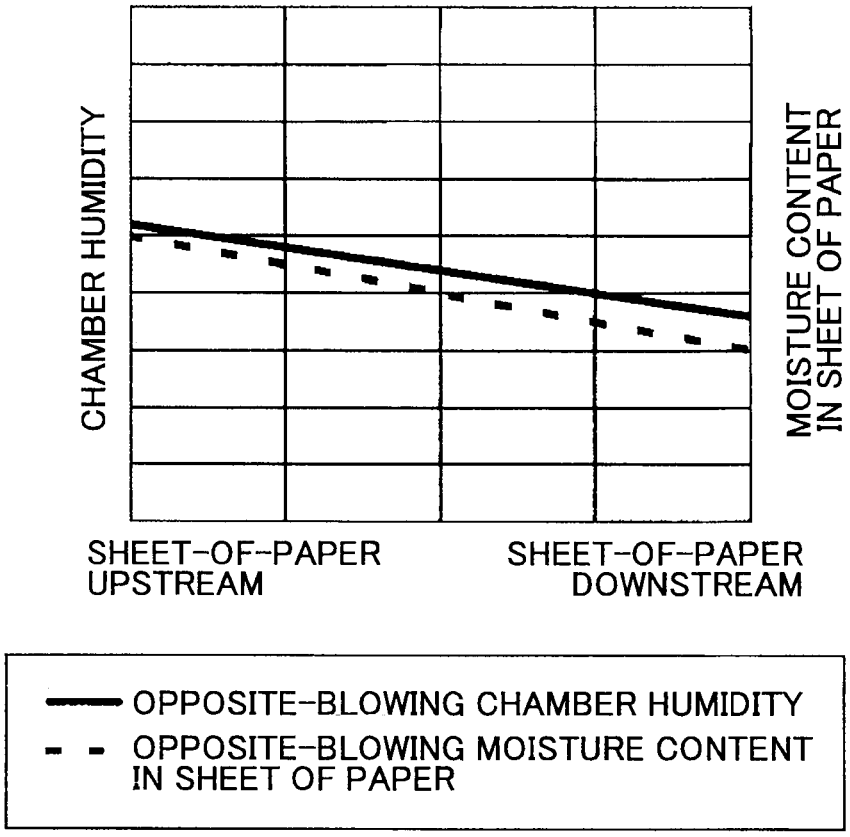
FIG. 13 shows a characteristic graph of drying characteristics in a case where the paper drying control operations are carried out through the control procedure shown in FIG. 10, and shows an example where blowing is carried out in a direction reverse to the direction of conveying a sheet of paper.

FIGS. 11, 12 and 13 are characteristic graphs in a case where control of drying the sheet of paper 10 is carried out through the control procedure of FIG. 10. FIG. 11 shows a relationship between the humidity in the inside of the chamber 412 and the moisture content in the sheet of paper 10 in a case where the conveyance direction of the sheet of paper 10 and the blowing direction are the same as one another (forward blowing) (corresponding to the embodiment of FIGS. 2-3) and the blowing speed is low. FIG. 12 shows a relationship between the humidity in the inside of the chamber 412 and the moisture content in the sheet of paper 10 in a case where the conveyance direction of the sheet of paper 10 and the blowing direction are the same as one another (forward blowing) (corresponding to the embodiment of FIGS. 2-3) and the blowing speed is high. In any case, the detection was carried out from the upstream side through the downstream side of the sheet of paper 10. The solid line represents the humidity in the inside of the chamber 412 and the broken line represents the moisture content in the sheet of paper 10. It is noted that the humidity in the inside of the chamber 412 was detected by means of humidity sensors equal to the humidity sensor 405 of the chamber 412 arranged in parallel along the paper conveyance direction. In an actual product, the humidity sensor 405 is installed at the downstream side, and thus, the detection value at the downstream side is used as a reference value. Further, high and low in the blowing speed are relative ones, and a case of lower and a case of higher than a (sheet of paper) conveyance speed of 75 m/min through 150 m/min as the above-mentioned printing speed were assumed. For example, the case of lower is a case where the blowing speed is on the order of equal to the printing speed, and the case of higher is a case where the blowing speed is equal to or higher than the printing speed.

From the characteristics of FIG. 11, in a case where the blowing speed of the high temperature dried air Ah is relatively slow, the inside of the chamber 412 comes to have high humidity, and the moisture content in the sheet of paper 10 is not reduced even at the paper-conveyance-direction downstream side. This is because after the air layer of the high temperature dried air Ah near the surface of the sheet of paper 10 has reached having the saturated water vapor content, since the air layer near the surface is not easily replaced because of the low relative speed, moisture in the sheet of paper 10 does not evaporate and is not transferred to the air layer.

In contrast thereto, in a case where the blowing speed of the high temperature dried air Ah is relatively high, as can be seen from the characteristics of FIG. 12, the relative speed is increased, and the air layer having reached the saturated water vapor content is rapidly replaced. As a result, the humidity slope in the chamber 412 becomes gentle, and high humidity does not occur. Therefore, the moisture content in the sheet of paper 10 is reduced, and the efficiency of drying the sheet of paper 10 is improved. Further, in the characteristics of FIG. 12, the humidity in the chamber 412 and the moisture content in the sheet of paper 10 have the slopes reverse to one another. However, since the two slopes are gentle, it is possible to avoid areal unevenness in degree of being dried on the sheet of paper 10.

On the other hand, FIG. 13 shows characteristics of a relationship between the humidity in the chamber 412 and the moisture content in the sheet of paper 10 in a case where the conveyance direction of the sheet of paper 10 and the blowing direction are reverse (opposite blowing) (corresponding to the above-mentioned other embodiment of FIGS. 4-5). In this case, even if the blowing speed is slow, the relative speed with respect to the conveyance speed of the sheet of paper 10 is high, and thus, the same as in the case of FIG. 12 where the relative speed is high in the forward blowing, the saturated air layer is rapidly replaced and thus, it is seen that the efficiency of drying the sheet of paper 10 is high. Further, since it can be seen from the characteristics that the humidity in the chamber 412 and the moisture content in the sheet of paper 10 have the same slope, areal unevenness in degree of being dried on the sheet of paper 10 is not likely to occur.

It is noted that along with conveyance of the sheet of paper 10, the dried air on the surface of the sheet of paper 10 has a speed component in the direction of conveyance of the sheet of paper 10. Therefore, in order to transfer moisture from the sheet of paper 10 to the dried air efficiently, it is necessary that at least the humidity in the air layer on the surface of the sheet of paper 10 when moisture is transferred to the dried air is in an equilibrium state of not having reached the saturated water vapor content. That is, when the water vapor content in the air layer near the surface of the sheet of paper 10 becomes the saturated state, moisture in the sheet of paper 10 cannot be transferred to the air layer, and thus, the moisture content in the sheet of paper 10 is not reduced. Therefore, it is necessary that the relative speed between the high temperature dried air Ah and the sheet of paper 10 is such that the saturated state does not occur. Most suitably, the relative speed such that the equilibrium state can be always maintained with the largest transfer rate of moisture to the air layer is the most efficient speed. It is noted that the equilibrium state means a state where water evaporates at the same rate and is transferred to the high temperature dried air Ah, and the humidity of the high temperature dried air Ah is maintained at a level equal to or less than the saturated vapor pressure.

This speed depends also on the temperature and humidity of the high temperature dried air Ah and an ink amount used for printing on the sheet of paper 10. Therefore, the optimum relationships between the temperature, the driving speed (rotational speed) of the blower 420, the driving speeds (rotational speeds) of the pressure reduction unit 460 and the compression unit 450, and the ink amount (moisture) corresponding to the various humidity values may be obtained experimentally. Then, the obtained optimum relationships may be stored as the above-mentioned data tables of the reference values (reference data). Then, at a time of actual operations, the data table may be selected according to the humidity in the inside of the chamber 412 detected by the humidity sensor 405. In a case where the appropriate values do not exist in the data tables, the operating conditions having the highest efficiency may be determined by using interpolation calculation; the blower 420, the pressure reduction unit 460 and the compression unit 450 may be driven according to the determined operating conditions and the sheet of paper 10 may be dried.

It is noted that the above-mentioned ink amount corresponds to the above-mentioned print density used in step S5 of FIG. 10. Therefore, the higher the print density is, the larger the ink amount supplied to the sheet of paper 10 becomes, and for that, it is necessary to increase the blowing speed or the temperature of the high temperature dried air Ah so that the above-mentioned equilibrium state of transferring moisture to the air layer is increased. Similarly, in a case where the humidity in the chamber 412 is high, this means that the rate of transferring moisture from the sheet of paper 10 is high, or replacement of the dried air saturated by moisture is slow. For that, the blowing speed is increased or the temperate of the high temperature dried air Ah is increased so that the above-mentioned equilibrium state is increased. These conditions (states) can be experimentally obtained, and thus, as mentioned above, the above-mentioned data tables include also the print densities and the humidity as the parameters.

Further, for determining the driving speed of the blower 420, the blowing speed in the chamber 412 is to be considered. Therefore, it is necessary to take the speed losses in the blowing paths 410*a*, 410*b*, the first and second ducts 411, 413, the chamber 412 and so forth into consideration. Further, in a case of determining the driving speeds of the pressure reduction unit 460 and the compression unit 450, the heat losses at the above-mentioned respective parts should be taken into consideration. In order to reduce the heat losses, it is preferable to use materials having thermal conductivity of equal to or less than 2 W/(m·K) for the chamber 412, the first and second ducts 411, 413 and the blowing paths 410*a*, 410*b* used to connect between the chamber 412 and the heat pump 406. Thereby, it is possible to minimize degradation in the thermal efficiency, and accelerate reducing power consumption.

Thus, according to the embodiments of the present invention, the following advantages are obtained.

(1) Since the heat pump 406 is used for drying the sheet of paper 10, it is possible to cope with both positively drying the sheet of paper 10 by the high temperature dried air (dehumidification air) Ah and reducing power consumption. As for reducing power consumption, reducing power consumption up to on the order of three times is expected in comparison to a case of using a heater as in the prior art.

(2) Since the high temperature dried air Ah is generated by the heat pump 406 and is circulated in the chamber 412, it is possible to positively change moisture removed from the sheet of paper 10 in the chamber 412 into water droplets in the heat pump 406. Thereby, the apparatus environment can be prevented from having high humidity, and ventilation equipment for ejecting moisture to the outside of the room in which the apparatus is installed is not necessary. Thus, it is possible to purify the apparatus environment and cut down expenses of the equipment.

(3) By using the materials of low thermal conductivity for the chamber 412, the ducts 411, 413 and the blowing paths 410*a*, 410*b*, it is possible to reduce the heat dissipation amount along the blowing circulation path, and thus, it is possible to further reduce power consumption.

(4) By moving the high temperature dried air Ah on the surface of the sheet of paper 10 at a higher speed than the conveyance speed of the sheet of paper 10 when the high temperature dried air Ah is blown in the forward direction as the paper conveyance direction, it is possible to replace air containing moisture Aw to which moisture has been transferred from the sheet of paper 10 by dried air having a higher speed than the sheet of paper 10 in the chamber 412. Thereby, it is possible to improve the drying efficiency.

(5) By blowing the high temperature dried air Ah in a direction reverse to a direction of conveying the sheet of paper 10, the relative speed becomes higher than the conveyance speed of the sheet of paper 10. Therefore, it is possible to positively replace air containing moisture Aw to which moisture has been transferred from the sheet of paper 10 by dried air. Thereby, it is possible to improve the drying efficiency.

(6) By determining the temperature of the high temperature dried air Ah supplied by the heat pump 406 at 50° C. through 100° C., it is possible to avoid shrinkage of the sheet of paper 10, and also, it is possible to avoid insufficient drying. That is, in a case where drying is carried out with the high temperature dried air Ah of equal to or higher than 100° C., the shrinkage speed of the sheet of paper 10 is high, and the shrinkage amount of the sheet of paper 10 during acceleration and deceleration is large. In contrast, in a case where drying is carried out with the high temperature dried air Ah of less than 100° C., the shrinkage speed of the sheet of paper 10 is low, and the shrinkage amount of the sheet of paper 10 during acceleration and deceleration is not large. In a case where drying is carried out with the high temperature dried air Ah of equal to less than 50° C., the saturated water vapor content is small. Therefore, drying may become insufficient. In contrast, in a case where drying is carried out with the high temperature dried air Ah of higher than 50° C., it is possible to ensure the saturated water vapor content suitable for drying. Therefore, drying of the sheet of paper 10 does not become insufficient.

(7) As to characteristics of starting up the heat pump 406, a time period equal to or more than 20 minutes may be required for obtaining a state where stable warm air can blown. As can be seen from the flowchart of FIG. 10, until printing is started in step S8, idling operations of the pressure reduction unit 460 and the compression unit 450 are carried out during steps S2 through S7. After that, the blower 420 is started up. Thus, the idling operations may be carried out before starting printing until the certain conditions concerning operations of the heat pump 406 are fulfilled. Thereby, it is possible to improve the starting up characteristics of the heat pump 406.

(8) The operations of the heat pump 406 are controlled based on the print density (print coverage) information. Therefore, it is possible to carry out operations where the blowing temperature and the blowing speed are reduced when printing at a low density is carried out, for example. Thus, it is possible to achieve a further lower power consumption. Further, when printing at a high density is carried out, it is possible to carry out operations of the heat pump 406 efficiently depending on the ink amount used in the printing at the high density.

(9) The humidity sensor 405 is provided in the chamber 412, and the heat pump 406 is controlled by reading the reference data (reference values) based on the information of humidity in the chamber 412. Therefore, by avoiding deformation of the sheet of paper 10 otherwise occurring due to excessive drying of the sheet of paper 10 under a low humidity condition, it is possible to guarantee quality of printed products. Further, it is possible to avoid insufficient drying of the sheet of paper 10 under a high humidity condition.

(10) The shutter 414 is provided in the chamber 412, and the flow cross sectional width for the high temperature dried air Ah in the chamber 412 is varied and controlled. Thereby, it is possible to reduce the space volume in the chamber 412 depending on the width of the sheet of paper 10 in a case where printing is carried out on the sheet of paper 10 having a narrow width. Thereby, the air amount to be heated and dried in the heat pump 406 is reduced, and it is possible to improve the starting up characteristics of the heat pump 406.

The present invention is not limited to the specifically disclosed embodiments, and variations and modifications may be made without departing from the scope of the present invention claimed. The embodiments are preferable embodiments, and the person skilled in the art may realize various alternative configurations, modified configurations, improved configuration, and so forth; these configurations are included in the scope of the present invention claimed.

The present application is based on Japanese Priority Patent Application No. 2010-237701 filed Oct. 22, 2010, the entire contents of which are hereby incorporated herein by reference.

What is claimed is:

1. An inkjet recording apparatus capable of discharging ink from a recording head and forming a printed image on a sheet-shaped recording medium, comprising:

a drying chamber provided on a downstream side of the recording head along a conveyance path of the sheet-shaped recording medium;

a drying unit configured to circulate gas by using plural ducts connected to the drying chamber;

a shutter member disposed in the drying chamber parallel to a conveyance direction of the sheet-shaped recording medium and movable in directions perpendicular to the conveyance direction of the sheet-shaped recording medium; and a driving part configured to drive the shutter member in the directions perpendicular to the conveyance direction of the sheet-shaped recording medium, and control a flow cross sectional area for the gas in the drying chamber, wherein the drying unit includes a heat pump configured to separate water droplets from the gas, heat the gas to be high temperature dried gas, supply the gas as the high temperature dried gas to the drying chamber from a duct of the drying chamber on a gas supply side, cause moisture to move in the drying chamber from the sheet-shaped recording medium to the gas as the high temperature dried gas, and return the gas to the inside of the drying unit from a duct of the drying chamber on a gas discharge side after the moisture has been moved in the drying chamber to the gas.

2. The inkjet recording apparatus as claimed in claim 1, wherein the driving part changes the flow cross sectional area according to a width of the sheet-shaped recording medium.

3. The inkjet recording apparatus as claimed in claim 1, wherein the drying chamber and the plural ducts are made of materials having thermal conductivity of equal to or less than 2 W/(m·K).

4. The inkjet recording apparatus as claimed in claim 1, wherein a blowing direction of the gas toward the drying chamber is the same as a conveyance direction of the sheet-shaped recording medium, and a blowing speed of the gas is higher than a speed of conveying the sheet-shaped recording medium.

5. The inkjet recording apparatus as claimed in claim 1, wherein a blowing direction of the gas toward the drying chamber is opposite to a conveyance direction of the sheet-shaped recording medium.

6. The inkjet recording apparatus as claimed in claim 1, wherein a temperature of the high temperature dried gas supplied to the drying chamber is set within a range of 50° C. through 100° C.

7. The inkjet recording apparatus as claimed in claim 1, wherein the heat pump includes a heating medium that is separate from the gas, and wherein the heating medium is circulated through the heat pump in a closed circulation pipe line.

8. An inkjet recording apparatus capable of discharging ink from a recording head and forming a printed image on a sheet-shaped recording medium, comprising:

a drying chamber provided on a downstream side of the recording head along a conveyance path of the sheet-shaped recording medium; and a drying unit configured to circulate gas by using plural ducts connected to the drying chamber, wherein the drying unit includes a heat pump configured to separate water droplets from the gas, heat the gas to be high temperature dried gas, supply the gas as the high temperature dried gas to the drying chamber from a duct of the drying chamber on a gas supply side, cause moisture to move in the drying chamber from the sheet-shaped recording medium to the gas as the high temperature dried gas, and return the gas to the inside of the drying unit from a duct of the drying chamber on a gas discharge side after the moisture has been moved in the drying chamber to the gas, wherein the heat pump includes a compression unit, a pressure reduction unit and a blower; and the compression unit and the pressure reduction unit are operated before printing operations carried out by the recording head.

9. The inkjet recording apparatus as claimed in claim 8, further comprising:

a shutter member disposed in the drying chamber parallel to a conveyance direction of the sheet-shaped recording medium and movable in directions perpendicular to the conveyance direction of the sheet-shaped recording medium; and a driving part configured to drive the shutter member in the directions perpendicular to the conveyance direction of the sheet-shaped recording medium, and control a flow cross sectional area for the gas in the drying chamber.

10. The inkjet recording apparatus as claimed in claim 8, further comprising:

a control part configured to control a blowing speed of the blower of the heat pump according to a print density.

11. The inkjet recording apparatus as claimed in claim 10, wherein the control part is configured to cause the blowing speed of the blower to be higher in a case where the print density is higher than a case where the print density is lower.

12. The inkjet recording apparatus as claimed in claim 8, further comprising:

a control part configured to control driving speeds of the compression unit and the pressure reduction unit of the heat pump according to a print density.

13. The inkjet recording apparatus as claimed in claim 12, wherein the control part is configured to control the driving speed of the compression unit so that the temperature of the high temperature dried gas becomes higher in a case where the print density is higher than a case where the print density is lower.

14. The inkjet recording apparatus as claimed in claim 8, further comprising:

a detection part provided in the drying chamber and configured to detect humidity in the drying chamber; and a control part configured to control the compression unit, the pressure reduction unit and the blower of the heat pump according to a detection result of the detection part.

15. The inkjet recording apparatus as claimed in claim 14, wherein the control part is configured to control the blower so that a blowing speed becomes higher in a case where the detected humidity is higher than a case where the detected humidity is lower.

16. The inkjet recording apparatus as claimed in claim 14, wherein the control part is configured to control the compression unit so that the temperature of the high temperature dried gas becomes higher in a case where the detected humidity is higher than a case where the detected humidity is lower.

17. A printing method in an inkjet recording apparatus capable of discharging ink from a recording head and forming a printed image on a sheet-shaped recording medium, wherein the inkjet recording apparatus includes a drying chamber provided on a downstream side of the recording head along a conveyance path of the sheet-shaped recording medium; and a drying unit configured to circulate gas by using plural ducts connected to the drying chamber, wherein the drying unit includes a heat pump configured to separate water droplets from the gas, heat the gas to be high temperature dried gas, supply the gas as the high temperature dried gas to the drying chamber from a duct of the drying chamber on a gas supply side, cause moisture to move in the drying chamber from the sheet-shaped recording medium to the gas as the high temperature dried gas, and return the gas to the inside of the drying unit from a duct of the drying chamber on a gas discharge side after the moisture has been moved in the drying chamber to the gas, and the printing method comprises:

when starting printing operations, reading reference data for printing stored in a data storage part and obtaining control conditions of a pressure reduction unit and a compression unit of the heat pump;

starting idling operations of the pressure reduction unit and the compression unit according to the obtained control conditions;

when receiving printing data from a host apparatus, extracting print density data from the printing data;

reading reference data from the data storage part corresponding to the extracted print density data and obtaining control conditions of the pressure reduction unit and the compression unit;

starting printing under the obtained control conditions;

detecting humidity in the drying chamber;

reading reference data from the data storage part corresponding to the detected humidity and the extracted print density data, and obtaining control conditions of the pressure reduction unit and the compression unit; and carrying out printing under the obtained control conditions.

* * * * *